US005940096A

United States Patent [19]

Komplin et al.

[11] Patent Number: 5,940,096

[45] **Date of Patent: *Aug. 17, 1999**

[54] INK JET PRINTHEAD ASSEMBLY WITH NON-EMITTING ORIFICES

[75] Inventors: Steven Robert Komplin; Ashok Murthy; James Harold Powers, all of Lexington, Ky.

[73] Assignee: Lexmark International, Inc., Lexington, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 08/659,103

[22] Filed: Jun. 3, 1996

[51] Int. Cl.[6] ..... B41J 2/135

[52] U.S. Cl. ..... 347/44; 347/67; 347/94

[58] Field of Search ..... 347/94, 67, 65, 347/47, 44

[56] References Cited

U.S. PATENT DOCUMENTS

| | | | |
|---|---|---|---|
| 4,542,389 | 9/1985 | Allen | 347/44 |
| 4,550,326 | 10/1985 | Allen et al. | 347/44 |
| 4,578,687 | 3/1986 | Cloutier et al. | 347/44 |
| 4,646,110 | 2/1987 | Ikeda | 347/15 |
| 4,914,562 | 4/1990 | Abe et al. | 347/63 |
| 4,914,736 | 4/1990 | Matsuda | 347/63 |
| 4,980,703 | 12/1990 | Sakurai | 347/44 X |
| 4,994,825 | 2/1991 | Saito et al. | 347/63 |
| 5,198,834 | 3/1993 | Childers | 347/65 |
| 5,374,948 | 12/1994 | Saito et al. | 347/47 |

*Primary Examiner*—Joseph Hartary
*Attorney, Agent, or Firm*—John A. Brady

[57] ABSTRACT

The invention is directed to an ink jet printhead assembly for jetting a supply of ink onto a print medium. A printhead includes a substrate and a plurality of heater elements mounted on the substrate. A nozzle plate is attached to the printhead. The nozzle plate and/or substrate includes an ink feed channel and a plurality of ink chambers. The nozzle plate includes a plurality of ink emitting orifices and a plurality of non-emitting orifices. Each ink emitting orifice is associated with a respective one of the ink chambers and is positioned adjacent to a respective one of the heater elements. Each ink chamber is in fluid communication with the ink feed channel at a first fluid port and in fluid communication with a respective one of the non-emitting orifices at a second fluid port.

16 Claims, 2 Drawing Sheets

INK JET PRINTHEAD ASSEMBLY WITH NON-EMITTING ORIFICES

BACKGROUND OF THE INVENTION

1. Field of the Invention

The present invention relates to an ink jet printhead assembly for use in ink jet printers, and, more particularly, to an ink jet printhead assembly including a nozzle plate with a plurality of ink emitting orifices and a plurality of non-emitting orifices.

2. Description of the Related Art

An ink jet printer typically includes an ink jet printhead assembly having a nozzle plate which is mounted in spaced apart relationship to a printhead. The nozzle plate includes a plurality of ink emitting orifices which are respectively disposed in association with a plurality of heater elements mounted on the printhead. When a particular heater element is actuated or fired, ink disposed adjacent thereto rapidly expands to form a vapor bubble. Ink is expelled through the orifice by the bubble and is jetted onto the print medium.

A problem which sometimes occurs when utilizing a printhead assembly as described above is commonly referred to as "cross-talk." In particular, the nozzle plate is disposed in spaced apart relationship to the printhead, whereby each orifice is disposed in direct fluid communication with an adjacent orifice. The expansion of ink between the nozzle plate and printhead caused by actuating one or more heater elements may, in the worst case, cause jetting of ink from a non-fired orifice. Such "cross-talk" may result in a random sprinkling of ink droplets superimposed onto the printed text, which is obviously not desirable.

One known solution which is used to inhibit cross-talk involves the use of mechanical barrier walls which extend between the nozzle plate and printhead and are disposed between the ink emitting orifices. The barrier walls prevent expanding fluid which occurs upon actuation of a heater element from travelling toward an adjacent orifice.

Another known solution which is used to prevent cross-talk involves the use of a plurality of non-emitting slots which are formed in the nozzle plate. Each non-emitting slot is in the form of an elongated slot associated with a plurality of ink emitting orifices. The nozzle plate is merely disposed in spaced apart relationship to the printhead and no barrier walls or other flow inhibiting structures extend between the nozzle plate and printhead. Each ink emitting orifice is therefore in direct fluid communication with an adjacent ink emitting orifice. The elongated slots are intended to absorb the expansion and contraction of the ink upon firing of a heater element to prevent propagation of fluid surges to adjacent ink emitting orifices, and thereby inhibit cross-talk between the ink emitting orifices.

Another problem with a conventional printhead assembly as described above is that upon firing of a particular heater element, the fluid dynamics within the associated ink emitting orifice are such that a certain minimum time must elapse before the corresponding heater element can be fired again. To wit, when a particular heater element is fired, ink which is in the associated orifice is jetted therefrom onto the print medium, thereby leaving a void or zone of low pressure. The supply of ink between the nozzle plate and printhead rushes into the evacuated ink emitting orifice to fill the same. The inflowing ink momentarily overfills the orifice and then drops back such that the orifice is slightly underfilled. This sets up an oscillation which takes a certain amount of time to settle down. Accordingly, a period of time is required before the heater element can again be actuated, referred to as the "settling time."

The above-mentioned known structures which are utilized for preventing cross-talk between ink emitting orifices are not effective to reduce the settling time of a particular fired heater element and associated ink emitting orifice. Such designs are merely intended to absorb fluid propagation between adjacent ink emitting orifices formed in the nozzle plate.

What is needed in the art is a printhead assembly which reduces the settling time in each ink emitting orifice after ink is jetted therefrom, thereby enabling a faster printing speed.

SUMMARY OF THE INVENTION

The present invention provides a printhead assembly having a nozzle plate with a plurality of non-emitting orifices which are respectively disposed in direct fluid communication with one of a plurality of ink emitting orifices.

The invention comprises, in one form thereof, an ink jet printhead assembly for jetting a supply of ink onto a print medium. A printhead includes a substrate and a plurality of heater elements mounted on the substrate. A nozzle plate is attached to the printhead. The nozzle plate and/or substrate includes an ink feed channel and a plurality of ink chambers. The nozzle plate includes a plurality of ink emitting orifices and a plurality of non-emitting orifices. Each ink emitting orifice is associated with a respective one of the ink chambers and is positioned adjacent to a respective one of the heater elements. Each ink chamber is in fluid communication with the ink feed channel at a first fluid port and in fluid communication with a respective one of the non-emitting orifices at a second fluid port.

An advantage of the present invention is that the settling time associated with each ink emitting orifice in the nozzle plate is substantially reduced, thereby allowing a faster printing speed.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
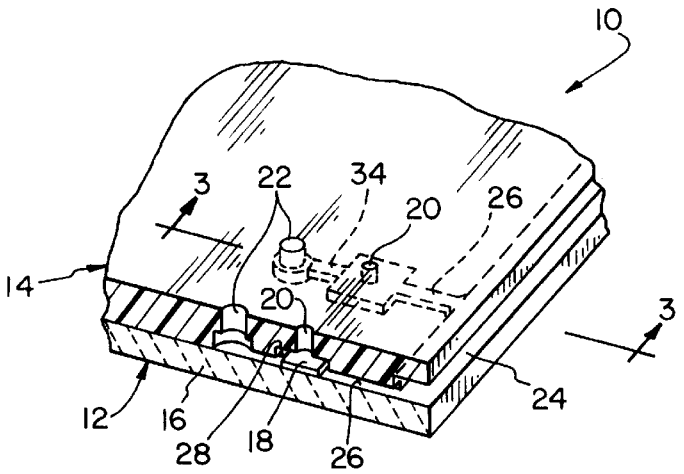
FIG. 1 is a fragmentary, perspective view of an embodiment of an ink jet printhead assembly of the present invention.

Referring now to the drawings, and more particularly to FIG. 1, there is shown an embodiment of an ink jet printhead assembly 10 of the present invention for jetting a supply of ink onto a print medium (not shown). Ink jet printhead assembly 10 is mounted in known fashion to an ink jet cartridge or pen (not shown), and generally includes a printhead 12 and a nozzle plate 14.

Printhead 12 (FIGS. 1 and 3) includes a substrate 16 and a plurality of heater elements 18 mounted thereon. In the embodiment shown, substrate 16 is in the form of a silicon strip, although other types of materials may be used. Moreover, in the embodiment shown, heater elements 18 are in the form of a hafnium diboride or tantalum-aluminum resistor, although other types of heater elements may likewise be used.

Nozzle plate 14 (FIGS. 1–3) is attached to printhead 12, such as by an adhesive. Nozzle plate 14 includes a plurality of ink emitting orifices 20 and a plurality of non-emitting orifices 22. Each ink emitting orifice 20 is disposed in fluid communication with the supply of ink (to be described hereinafter), and is positioned adjacent to a respective one of heater elements 18. Each non-emitting orifice 22 is disposed only in direct fluid communication with a respective one of ink emitting orifices 20 (as will be described hereinafter). The dimensions of each ink emitting orifice 20 and non-emitting orifice 22 (as well as the other structural features of nozzle plate 14) are dependent upon the specific application with which nozzle plate 14 is used. For example, the dimensions of each ink emitting orifice 20 and non-emitting orifice 22 will vary dependent upon the resolution of the particular printer application. The dimensions set forth hereinafter corresponding to structural features of nozzle plate 14 correspond to a printer resolution of 600 dpi, although other printer resolutions are also possible. In the embodiment shown, each ink emitting orifice 20 has a diameter of between approximately 10 and 60 microns, and preferably between approximately 20 and 50 microns, and more preferably is approximately 29 microns. Moreover, in the embodiment shown, each non-emitting orifice 22 has a diameter of between approximately 20 and 80 microns, and preferably between approximately 30 and 60 microns, and more preferably is approximately 39 microns.

Nozzle plate 14 is configured to include an ink feed channel defined by a primary ink feed channel 24 and a plurality of branching ink feed channels 26. Each branching ink feed channel 26 is disposed in fluid communication with a respective one of ink emitting orifices 20. That is, branching ink feed channels 26 extend between and fluidly connect primary ink feed channel 24 with ink emitting orifices 20, respectively. In the embodiment shown, primary ink feed channel 24 is fluidly connected with the supply of ink contained within the ink jet cartridge to which ink jet printhead assembly 10 is attached. Primary ink feed channel 24 and branching ink feed channels 26 are preferably formed in nozzle plate 14 using an excimer laser photoablation process. In the embodiment shown, primary ink feed channel 24 and branching ink feed channels 26 preferably have a depth (i.e., extending perpendicular to the drawing of FIG. 2) of between approximately 10 and 50 microns; and preferably between approximately 20 and 30 microns; and more preferably approximately 24 microns. Moreover, in the embodiment shown, branching ink feed channels 26 preferably have a width (i.e., extending perpendicular to the drawing of FIG. 3) of between approximately 10 and 50 microns, and more preferably 25 microns; and a length (i.e., extending in the flow direction through branching ink feed channels 26) of between 5 and 100 microns, and preferably approximately 60 microns.

Nozzle plate 14 also includes a plurality of ink chambers 28 which are respectively associated with ink emitting orifices 20. Each ink chamber 28 is disposed in fluid communication with a respective branching ink feed channel 26 at a first fluid port 30, and in fluid communication with a respective one of non-emitting orifices 22 at a second fluid port 32. In the embodiment shown, each ink chamber 28 has dimensions of 51×51 microns, with a depth of approximately 24 microns.

Each ink chamber 28 is fluidly connected with an associated non-emitting orifice 22 via a respective throat 34 formed in nozzle plate 14. Each throat 34 thus indirectly connects one of ink emitting orifices 20 with a respective one of non-emitting orifices 22. In the embodiment shown, each throat 34 has a width of approximately 10 microns (i.e., in a direction perpendicular to the drawing of FIG. 3); a length of approximately 10 microns (i.e., in the flow direction through throat 34); and a depth of between approximately 10 and 50 microns, and preferably between approximately 20 and 30 microns, and more preferably is approximately 24 microns (i.e., in a direction perpendicular to the drawing of FIG. 2).

During use, ink flows from the ink jet cartridge and into primary ink feed channel 24. The ink also flows through each of branching ink feed channels 26. For ease of discussion, the operation through only one branching ink feed channel 26, ink emitting orifice 20 and associated non-emitting orifice 22 will be discussed. To wit, ink flows through branching ink feed channel 26 and into an ink chamber 28 disposed adjacent to an associated ink emitting orifice 20. Ink also flows from ink chamber 28 and into non-emitting orifice 22 via throat 34. During a steady state condition of inoperation, the ink is disposed within ink emitting orifice 20 and non-emitting orifice 22 at a particular predetermined level. Upon firing of heater element 18, the ink disposed adjacent thereto rapidly expands and is jetted from ink emitting orifice 20. This causes an area of low pressure within ink chamber 28 and ink emitting orifice 20. This low pressure causes ink to be drawn into ink chamber 28 through both branching channel 26 and throat 34. This simultaneous flow of ink through first fluid port 30 and second fluid port 32 in to ink chamber 28 rapidly fills ink chamber 28 and ink emitting orifice 20 to a desired volume. Moreover, as ink is drawn from non-emitting orifice 22 into ink chamber 28 and ink emitting orifice 20 by the low pressure created therein, the capillary force within non-emitting orifice 22 serves to counteract the force created by the low pressure within ink chamber 28 and ink emitting orifice 20. Additionally, the simultaneous flow of ink in to ink chamber 28 from non-emitting orifice 22 and branching ink feed channel 26 results in fluid mixing and flow in opposite directions within ink chamber 28. It is thus probable that the reduction in settling time which is provided by the present invention is a result of simultaneous flow of ink into ink chamber 28; the capillary force within non-emitting orifice 22 which opposes the vacuum pressure within ink chamber 28; and the mixing of ink within ink chamber 28.

Figure 4:
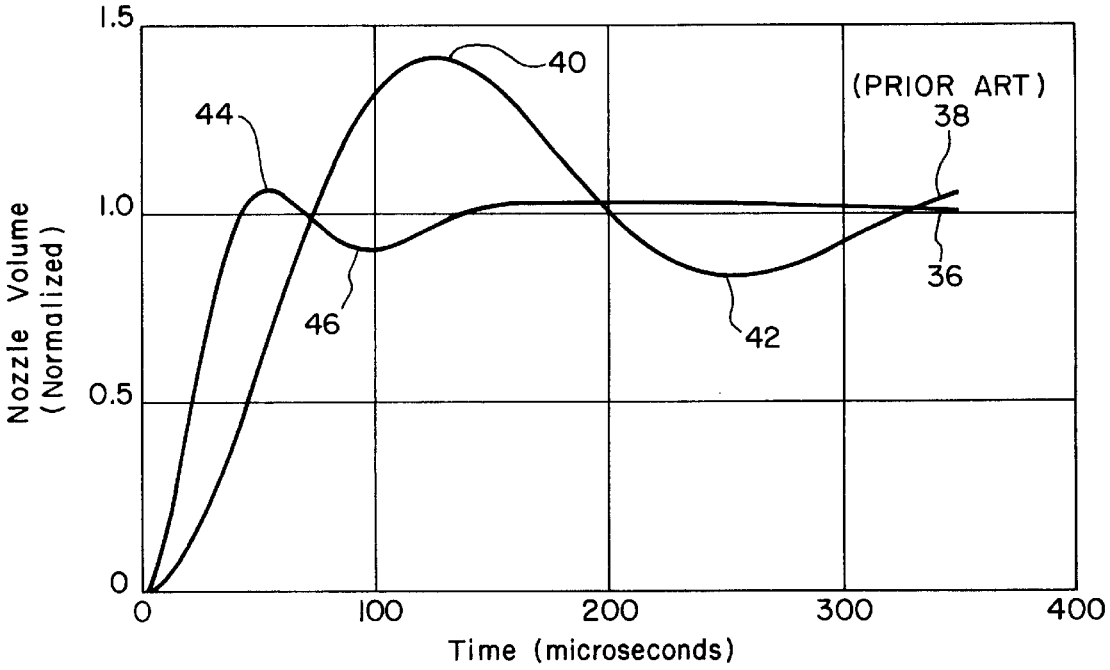
FIG. 4 is a graphical illustration of the settling times of an embodiment of an ink jet printhead assembly of the present invention in comparison with a conventional ink jet printhead assembly.

Referring now to FIG. 4, there is shown a graphical illustration of the improvement in settling time of ink jet printhead assembly 10 of the present invention in comparison wit h a conventional ink jet printhead assembly. Curve 36 illustrates the volume of ink within an ink emitting orifice or nozzle of printhead assembly 10 of the present invention;

and curve 38 illustrates a volume of ink within an ink emitting orifice or nozzle of a conventional printhead assembly. The horizontal axis represents the time in microseconds after a particular heater element is fired. The vertical axis represents the volume of ink within the ink emitting orifice or nozzle. The nozzle volume has been normalized such that the value 1.0 represents a particular desired level of ink within the ink emitting orifice or nozzle.

Referring first to curve 38, it may be seen that after the heater element is fired, the volume of ink reaches approximately 1.4 times the desired volume of ink, indicated by overfill condition 40. This occurs between 100 and 200 microseconds after the heater element is fired. Thereafter, the volume of ink within the nozzle subsides such that an underfill condition exists, as indicated by reference number 42. This underfill condition 42 occurs between 200 and 300 microseconds. It is thus apparent by observing the amplitude of the curve both above and below the desired ink volume of 1.0 that a substantial oscillation occurs upon firing of a heater element. The settling time of the ink jet printhead assembly corresponding to curve 38 is thus greater than approximately 300 microseconds.

Figure 2:
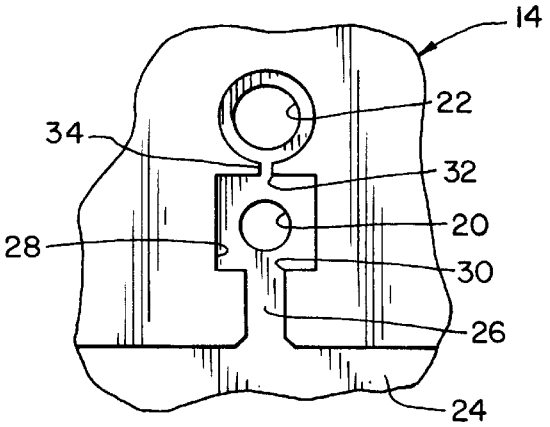
FIG. 2 is an enlarged, fragmentary view of a portion of a nozzle plate shown in the printhead assembly of FIG. 1.
Figure 3:
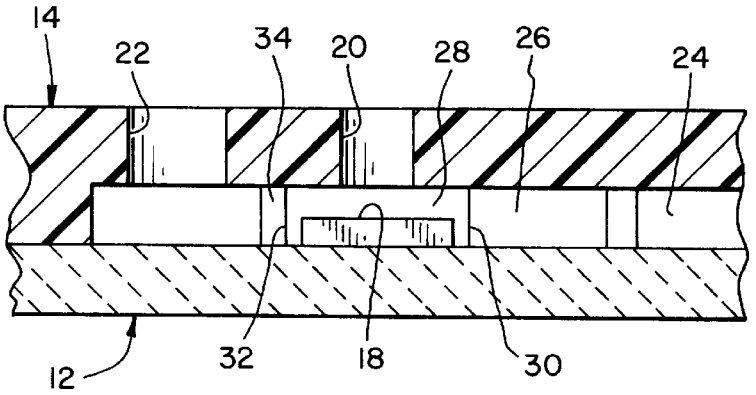
FIG. 3 is a sectional view taken along line 3—3 in FIG. 1.

Curve 36 illustrates the significantly improved settling time utilizing an ink jet printhead assembly of the present invention, such as printhead assembly 10 shown in FIGS. 1–3. The volume of ink within the nozzle reaches the normalized volume of 1.0 quicker than a conventional printhead assembly and has a significantly reduced amplitude above the normalized volume when an overfill condition occurs, as indicated by reference number 44. Similarly, the subsequently occurring underfill condition occurs at a much earlier point in time and has a significantly reduced negative amplitude in comparison with a conventional printhead assembly, as indicated by reference number 46. The settling time for curve 36 is thus approximately 150 microseconds (or about 150 microseconds less than the settling time of curve 38).

Figure 5:
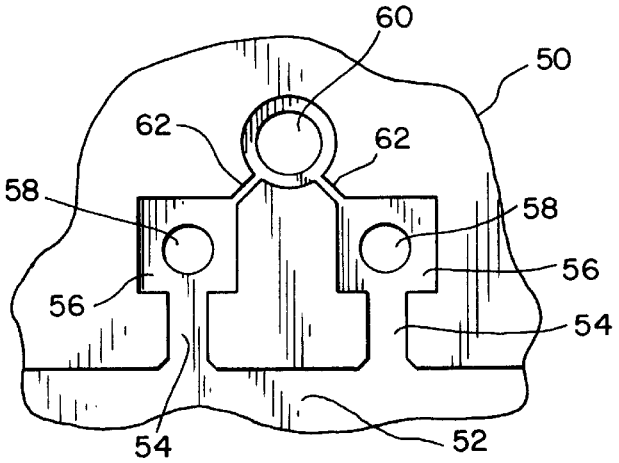
FIG. 5 is an enlarged, fragmentary view of a portion of another embodiment of a nozzle plate of the present invention.

Referring now to FIG. 5, another embodiment of a nozzle plate 50 of the present invention is shown. Nozzle plate 50 includes a primary ink feed channel 52, branching ink feed channels 54, ink chambers 56 and ink emitting orifices 58, similar to the respectively named elements shown in nozzle plate 14 of FIG. 2. However, in contrast with the embodiment of nozzle plate 14 shown in FIG. 2, nozzle plate 50 includes a non-emitting orifice 60 which is disposed in direct fluid communication with a plurality (i.e., two) ink emitting orifices 58. More particularly, non-emitting orifice 60 is directly fluidly connected to the two ink emitting orifices 58 via throats 62.

In the embodiments of the present invention shown in the drawings, the substrate of the printhead and/or the nozzle plate are configured to define the ink feed channel, plurality of ink chambers and plurality of throats. However, it is also to be understood that the ink feed channel, plurality of ink chambers and/or plurality of throats may be defined in a barrier layer distinct from and interposed between the nozzle plate and substrate. Such a barrier layer is intended to fall within the scope of the present invention, and may merely be viewed as a part of or extensions of the nozzle plate and/or substrate.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet printhead assembly for jetting a supply of ink onto a print medium, comprising:

a printhead including a substrate and a plurality of heater elements mounted on said substrate; and a nozzle plate attached to said printhead, at least one of said nozzle plate and said substrate including an ink feed channel and a plurality of ink chambers, said ink feed channel including a primary ink feed channel and a plurality of branching ink feed channels, each said branching ink feed channel having a first width, each said ink chamber having a second width greater than said first width of a corresponding said branching ink feed channel, said nozzle plate including a plurality of ink emitting orifices and a plurality of non-emitting orifices, each said ink chamber including a first fluid port in direct fluid communication with a corresponding branching ink feed channel, a second fluid port in direct fluid communication with a respective one of said non-emitting orifices through a throat, and a third fluid port defining a respective one of said ink emitting orifices, said first fluid port and said second fluid port positioned generally on opposite sides of said corresponding ink chamber, each said ink emitting orifice being positioned on a top surface of said corresponding ink chamber, said top surface being substantially perpendicular to said opposite sides, and each said ink chamber being positioned adjacent to a respective one of said heater elements, wherein the ink chamber is adapted such that firing of the heater element causes ink to be drawn from the throat, through the second fluid port, and into the ink chamber, causing a capillary force within the non-emitting orifice.

2. The ink jet printhead assembly of claim 1, wherein each said ink emitting orifice has a diameter of between approximately 20 and 30 microns, and each said non-emitting orifice has a diameter of between approximately 30 and 40 microns.

3. The ink jet printhead assembly of claim 1, wherein said nozzle plate includes said ink feed channel.

4. The ink jet printhead assembly of claim 1, wherein said ink feed channel has a selected depth of between approximately 10 and 50 microns.

5. The ink jet printhead assembly of claim 4, wherein said ink feed channel has a selected depth of between approximately 20 and 30 microns.

6. An ink jet printhead assembly for jetting a supply of ink onto a print medium, comprising:

a printhead including a substrate and a plurality of heater elements mounted on said substrate; and a nozzle plate attached to said printhead, at least one of said nozzle plate and said substrate at least in part defining an ink feed channel and a plurality of ink chambers, said nozzle plate including a plurality of ink emitting orifices and a plurality of non-emitting orifices, each said ink chamber including a first fluid port in fluid communication with said ink feed channel, a second fluid port in fluid communication with one of said non-emitting orifices, a third fluid port defining a respective one of said ink emitting orifices, each said ink emitting orifice being positioned adjacent to a respective one of said heater elements, and a plurality of throats, each said throat connecting each second fluid port with each non-emitting orifice wherein the firing of the heater element causes ink to be drawn into the ink chamber from the non-emitting orifice through the second fluid port and from the ink feed channel through the first fluid port resulting in mixing of the ink from the first and second fluid ports within the ink chamber and causing a capillary force within the non-emitting orifice.

7. The ink jet printhead assembly of claim 6, wherein each said heater element is disposed within a corresponding said ink chamber.

8. The ink jet printhead assembly of claim 6, wherein each said ink chamber includes a first width, each said second fluid port including a throat having a second width substantially smaller than said first width of said corresponding fluid chamber.

9. The ink jet printhead assembly of claim 8, wherein each said throat has a width of approximately 10 microns.

10. The ink jet printhead assembly of claim 8, wherein each said throat has a length of approximately 10 microns.

11. The ink jet printhead assembly of claim 8, wherein each said throat has a selected depth of between approximately 10 and 50 microns.

12. The ink jet printhead assembly of claim 8, wherein each said throat has a selected depth of between approximately 20 and 30 microns.

13. The ink jet printhead assembly of claim 8, wherein each said non-emitting orifice, each said second fluid port and each said throat is non-thermally compensated.

14. An ink jet printhead assembly for jetting a supply of ink onto a print medium, comprising:

a printhead including a heater element; and a nozzle plate attached to the printhead, at least one of the nozzle plate and the printhead at least in part defining:

an ink feed channel;

a compartment, the compartment including a non-emitting orifice;

an ink chamber in fluid communication with the ink feed channel through a first fluid port and in fluid communication with the compartment through a throat connecting the ink chamber with the compartment, the ink chamber including an ink-emitting orifice, the ink chamber being positioned adjacent to the heater element, wherein the discharge of ink from the ink-emitting orifice causes ink to be drawn from the compartment, through the throat, and into the ink chamber, and ink to be drawn from the ink feed channel, through the first fluid port, and into the ink chamber, resulting in mixing of the ink from the compartment and the ink feed channel within the ink chamber.

15. The ink jet printhead assembly of claim 14, wherein the printhead and nozzle plate are integrally attached.

16. The ink jet printhead assembly of claim 14, wherein the first and second fluid ports are disposed on opposite sides of the ink chamber and the ink emitting orifice is disposed on a top surface of the ink chamber.

* * * * *